US005875988A

United States Patent [19]

Hashimoto

[11] Patent Number: 5,875,988

[45] Date of Patent: Mar. 2, 1999

[54] TOROIDAL COIL WINDING APPARATUS AND METHOD FOR WINDING A WIRE TOROIDALLY ON A CORE

[75] Inventor: Takashi Hashimoto, Tokyo, Japan

[73] Assignee: Tanaka Seiki Company Limited, Tokyo, Japan

[21] Appl. No.: 616,637

[22] Filed: Mar. 15, 1996

[30] Foreign Application Priority Data

Mar. 17, 1995 [JP] Japan ..... 7-059388

[51] Int. Cl.[6] ..... B65H 81/02; H01F 41/08

[52] U.S. Cl. ..... 242/434.8; 242/434.9; 29/605

[58] Field of Search ..... 242/434.8, 434.9, 242/434.7; 29/605

[56] References Cited

U.S. PATENT DOCUMENTS

| | | | |
|---|---|---|---|
| 3,426,425 | 2/1969 | Brown et al. | 29/605 |
| 3,458,146 | 7/1969 | Warner | 242/434.9 X |
| 3,766,641 | 10/1973 | Metzler et al. | 29/605 |
| 4,553,705 | 11/1985 | Uchida et al. | 242/434.8 |
| 4,564,998 | 1/1986 | Perschka et al. | 242/434.7 X |
| 4,988,047 | 1/1991 | Kariya et al. | 29/605 X |
| 5,086,983 | 2/1992 | Darrieux | 242/434.8 X |
| 5,507,442 | 4/1996 | Konno et al. | 242/434.8 |
| 5,573,200 | 11/1996 | Sato et al. | 242/434.8 |

FOREIGN PATENT DOCUMENTS

| | | | |
|---|---|---|---|
| 0 132 843 | 2/1985 | European Pat. Off. . | |
| 363136610 | 6/1988 | Japan | 242/434.8 |

OTHER PUBLICATIONS

Patent Abstracts of Japan, Publication No. JP63034912, Publication Date Feb. 1988, vol. 12, No. 246.

Patent Abstracts of Japan, Publication No. JP61285706, Publication Date Dec. 1986, vol. 11, No. 148.

Patent Abstracts of Japan, Publication No. JP61180417, Publication Date Aug. 1986, vol. 11, No. 4.

Patent Abstracts of Japan, Publication No. JP58206112, Publication Date Dec. 1983, vol. 8, No. 8, No. 53.

Patent Abstracts of Japan, Publication No. JP61131411, Publication Date Jun. 1986, vol. 10, No. 319.

Patent Abstracts of Japan, Publication No. JP63034914, Publication Date Feb. 1988, vol. 12, No. 246.

J.T. Gulliksen, Core Winding Technique, IBM Technical Disclosure Bulletin, p. 450, Aug. 1965.

*Primary Examiner*—Donald P. Walsh
*Assistant Examiner*—Emmanuel M. Marcelo
*Attorney, Agent, or Firm*—Pillsbury Madison & Sutro LLP

[57] ABSTRACT

A winding apparatus suitable for a toroidal coil. Arms swivel around a core and move up and down. Movable bodies having rollers on which the wire is wound, are mounted on the arms and move along the arms. A tensioning mechanism pulls the movable bodies away from the core while adjusting the pulling forces separately. Chucks pass the wire through the center hole of the core from an entrance to an exit. One chuck holds the wire near a tip which has passed the center hole and brings the tip back to the entrance by crossing the moving path of rollers and moving around the core.

18 Claims, 20 Drawing Sheets

TOROIDAL COIL WINDING APPARATUS AND METHOD FOR WINDING A WIRE TOROIDALLY ON A CORE

BACKGROUND OF THE INVENTION

1. Field of the Invention

The present invention relates to a winding method and apparatus for a toroidal coil.

2. Description of the Related Art

In a toroidal coil, a wire W is helically wound on a ring-shape core CR as shown in FIG. 15. To wind the wire W on such a coil, it is necessary to alternate a process for inserting the wire W into the center hole CR1 of the core CR and a process for bringing the wire W, which has passed through the central hole CR1, back to the entrance side of the center hole CR1 in such a way that the wire W moves around the core CR. It is also necessary to keep tensioning the wire W during winding, to fix the wire W on the core CR and minimize the diameter of the coil. Japanese non-examined patent publication JP63-034912 discloses a method of mechanizing such winding processes as shown in FIGS. 16A through 16E.

In this method shown in FIG. 16A, a rod-shape jig J is attached to the tip of the wire W. A feed chuck A holds the end of the jig J. The feed chuck A moves toward the core CR so that the jig J inserts into the center hole CR1 of the core CR. A driving chuck B holds the tip of the jig J which passes through the center hole CR1.

At this time, a roller R1 is placed on the exit side of the center hole CR1. The roller R1 is hereinafter referred to as the first roller R1. Next, the jig J is released from the feed chuck A and is pulled out from the center hole CR1 by the driving chuck B as shown in FIG. 16B. The jig J then returns to the entrance side of the center hole CR1 such that the wire W is wound around the first roller R1 as shown by an arrow Ya, reaching the condition shown in FIG. 16C. Here, the end of the wire W is fixed near the core CR by an appropriate holding chuck D. After the jig J returns, the feed chuck A holds the end of the jig J and the driving chuck B moves over to the exit side of the center hole CR1. Then, as shown in FIG. 16D, the first roller R1 moves away from the core CR and swivels around the core CR as shown by an arrow Yb while tensioning the wire W. Here, some parts of the feed chuck A and the driving chuck B are omitted in FIG. 16D.

When the first roller R1 moves over to the opposite side of the core CR, the wire W is wound around the core CR as shown in FIG. 16E. At this time, a roller R2 (hereinafter referred to as the second roller R2) different from the first roller R1 is placed on the exit side of the center hole CR1. After the first roller R1 swivels up to the position illustrated in FIG. 16E, the feed chuck A moves toward the core CR and then the driving chuck B holds the tip of the jig J which has passed through the center hole CR1. In this manner, the condition shown in FIG. 16A is again reached. From then on, the wire W is wound by repeating the above-mentioned steps while alternating the rollers R1 and R2. After each round of the wire W winding, the core CR rotates on its own axis by the prescribed angle (the angle corresponding to one pitch of the helical coil wound on the core CR).

The above-mentioned winding method requires following complicated operations. The first roller R1 and the second roller R2 must be capable of interchanging their positions, and of moving separately in the axial direction of the core CR (the axial direction of the center hole CR1). Also, after the first round of the wire W winding (after returning to the condition in FIG. 16A for the first time), when the roller R1 (R2) on the exit side of the center hole CR1 of the core CR moves away from the core CR to tension wire W, the roller R2 (R1) on the entrance side of CR1 is also wound by wire W. Thus, this roller R2 (R1) on the entrance side must move toward the core CR synchronously with the motion of the roller R1 (R2) on the opposite side. Therefore, it is desirable to develop a winding apparatus which performs the above-described operations using simple mechanisms.

Also, the above-mentioned winding method has the following drawbacks. As shown in FIGS. 16C and 16D, the jig J which has passed through the center hole CR1, moves over to the entrance side of the center hole CR1 by operating the driving chuck B and is re-gripped by the feed chuck A. Then, the rollers R1 and R2 swivel. In this procedure, without the jig J, the wire W is pulled toward the exit side of the center hole CR1 when the tip of the wire W returns to the entrance side of the center hole CR1 by operating the driving chuck B. Thus, the wire W is bent over toward the exit side of the center hole CR1 at the holding position of the driving chuck B, and cannot be held by the feed chuck A. Therefore, the jig J is indispensable to secure the straight part which is necessary for the re-gripping. In addition, as shown by X in FIG. 16D, the wire W bends at the end of the jig J when the rollers R1 and R2 start swiveling after the jig J returns to the entrance side of the center hole CR1. Therefore, the wire W is likely to be deformed, and cut during repeated windings.

SUMMARY OF THE INVENTION

In view of the foregoing, it is an object of the present invention to provide a winding apparatus and a method which are capable of winding a toroidal coil by swiveling wound members such as a pair of rollers mentioned above.

It is another object of the present invention to provide a winding apparatus and method wherein a jig is not needed at the tip of a wire and the wire bending is avoided during the winding process.

The present invention achieves these objects by providing the following toroidal coil winding apparatuses.

According to the first aspect of the present invention, the toroidal coil winding apparatus has passing means, a movable body, a holding member and bringing back means. The passing means passes the wire through the center hole of the core from an entrance side to an exit side. The movable body on which the wire is wound, is movable in a direction of an axis of the core. The holding member holds a tip or its neighborhood of the wire which has come out to the exit side. The bring back means brings the holding member which is holding the tip or its neighborhood of the wire, back to the entrance side through crossing a moving path of the movable body on the exit side and moving around the core.

According to the second aspect of the present invention, the passing means has a feed chuck and a pull-out chuck. The feed chuck holds the wire at a position withdrawn by a predetermined length from a tip of the wire and inserts the wire into the center hole. The pull-out chuck grips the wire, which has been inserted into the center hole, on the exit side and pulls out the wire from the center hole. The feed chuck is capable of moving around the core between the entrance side and exit side. The feed chuck also works as the holding member and re-grips the wire, which has been pulled out by the pull-out chuck, at a position withdrawn by a predetermined length from a position held by the pull-out chuck.

Therefore, no jig is required at the tip of the wire. The winding apparatus does not need to change the jig every time when changing the core and the productivity becomes higher.

According to the third aspect of the present invention, the feed chuck also works as the bring back means.

According to the fourth aspect of the present invention, the toroidal coil winding apparatus tensions and straightens the wire near the tip by the feed chuck and the pull-out chuck.

According to the fifth aspect of the present invention, the bring back means has swiveling means, rotation means and control means. The swiveling means swivels the movable body from the exit side to the entrance side. The rotation means rotates the holding member on its axis. The control means controls the swiveling means and the rotation means such that a period to swivel the movable body overlaps with a period to rotate the holding member.

The tip of the wire rotates in parallel with the wound members swiveling around the core and winding the wire on the core. Therefore, the winding apparatus prevents the wire from unnecessary bending avoiding deformation of the wire and eliminating the danger of cutting the wire due to the repeated bending.

According to the sixth aspect of the present invention, the control means also controls the bring back means and the swiveling means such that a period to bring back the holding member overlaps with a period to swivel the movable body.

According to the seventh aspect of the present invention, the toroidal coil winding apparatus further has a pair of arms extending opposite to each other in an axial direction of the core. A pair of the movable bodies are mounted on the pair of arms respectively, such that the movable bodies are capable of moving in longitudinal directions of the arms.

Therefore, it is possible to drive movable bodies by required driving forces unaffected by the swivel motions of the arms.

According to the eighth aspect of the present invention, the toroidal coil winding apparatus further has a tension apply means. The tension apply means applies driving forces to the pair of movable bodies in the directions away from the core. The driving forces are adjustable separately for each movable body.

According to the ninth aspect of the present invention, the tension apply means has a pair of belts, winching means and torque adjust means. Each belt is routed via a center end and an outer end of each arm. Each end of the belts is connected to each of the movable bodies. The winching means winches the other ends of the belts independently. The torque adjust means controls torque of the winching means individually.

According to the tenth aspect of the present invention, the arms are capable of interchanging their positions by swiveling about the core and moving in an axial direction of the swiveling motion.

According to the eleventh aspect of the present invention, a winding method has three steps. The first step inserts the tip of the wire into the core from an entrance side to an exit side and pulls out the tip to the exit side. The second step moves the tip of the wire, which has been pulled out to the exit side, around the core and bring the tip back to the entrance side. The third step rotates the core by a predetermined angle. The winding method repeats these three steps. The first step includes steps of holding the wire at a position withdrawn by a predetermined length from the tip of the wire by the first chuck on the entrance side of the core, moving the first chuck such that the tip of the wire, which has been held, comes out to the exit side of the core, holding and then pulling out the tip of the wire which has been pulled out to the exit side, by the second chuck while opening the first chuck after the moving step, moving the first chuck from the entrance side to the exit side after the pulling out step, and re-gripping the wire at a position withdrawn from the tip by the first chuck. The second step includes steps of, winding the wire around the movable body by moving the first chuck around the movable body on the exit side in such a way that the tip of the wire, which has been held by the first chuck, faces the entrance side, and bringing the tip back to the entrance side by moving the first chuck and the movable body synchronously around the core while applying predetermined tension to the wire.

According to the twelfth aspect of the present invention, the toroidal coil winding apparatus has a first chuck, a moving mechanism, a second chuck, a winding mechanism, a tension apply mechanism, and a bring back mechanism. The first chuck is capable of moving between an entrance and exit sides of the core, and holds the wire at a position withdrawn by a predetermined length from a tip of the wire on the entrance side or the exit side of the core. The moving mechanism moves the first chuck such that the tip of the wire held on the entrance side comes out to the exit side of the core. The second chuck holds and pulls out the tip of the wire which has come out to the exit side. The winding mechanism winds the wire around the movable body by moving the first chuck around the movable body in such a way that the tip of the wire, which has been pulled out by the second chuck and re-gripped by the first chuck on the exit side, faces the entrance. The tension apply mechanism tensions the wire while the wire is wound around the movable body. The bring back mechanism brings the tip back to the entrance side by moving the first chuck and the movable body synchronously around the core while applying tension to the wire by the tension apply mechanism.

Other objects, features and advantages of the present invention will become apparent from the following description.

BRIEF DESCRIPTION OF DRAWINGS

The present invention is illustrated in the following drawings in which:

FIG. 13A is a perspective view taken from the back side of the circular arc ring. FIG. 13B is an enlarged view of part XIIIB in FIG. 13A;

DETAILED DESCRIPTION OF THE PREFERRED EMBODIMENTS

The present invention will be described in detail with reference to the accompanying drawings. The contents of Application No. 7-59388 filed on Mar. 17, 1995 in Japan is hereby incorporated by reference.

First Embodiment

Figure 1:
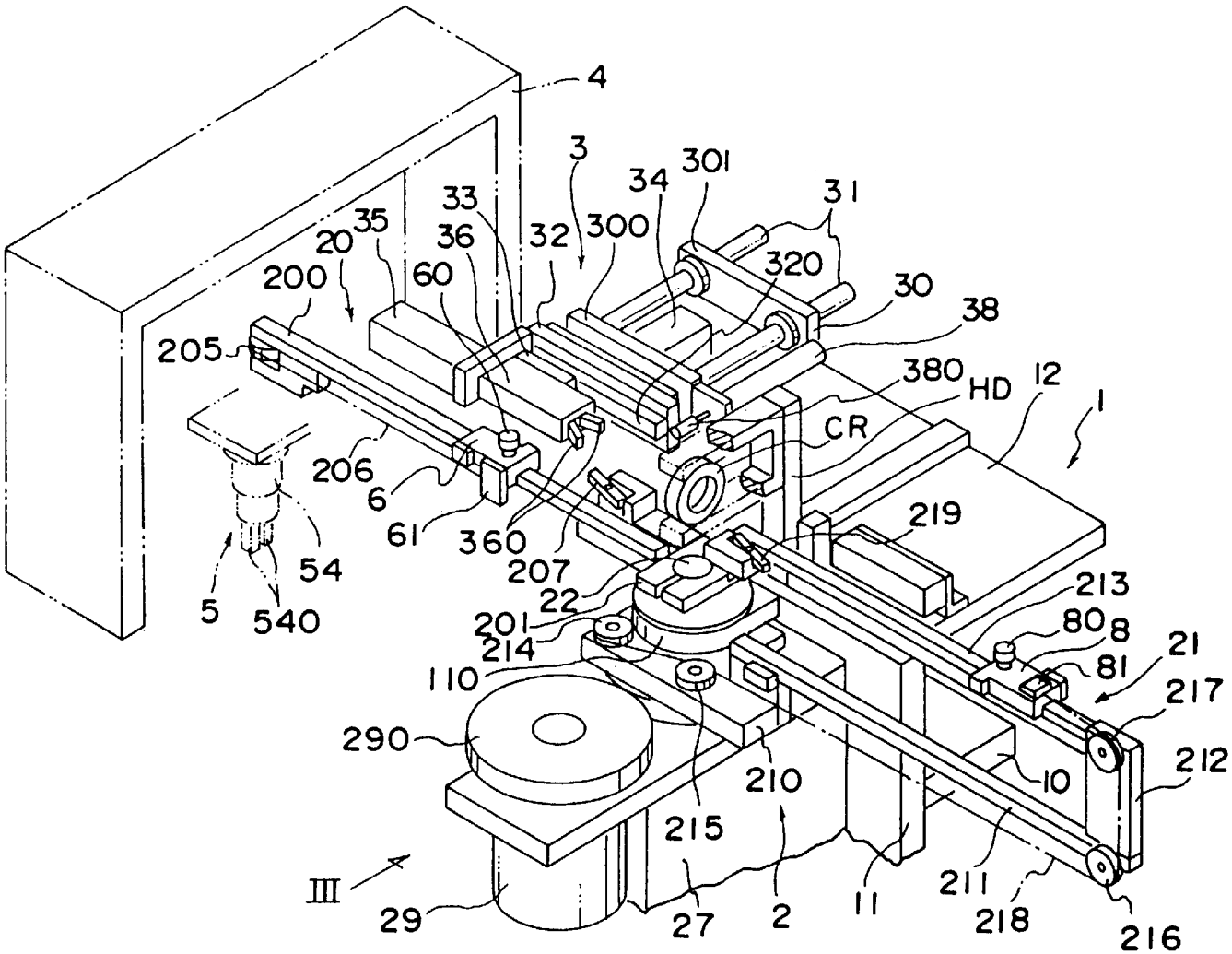
FIG. 1 is a perspective view mainly showing an arm mechanism in the winding apparatus of the first embodiment.
Figure 2:
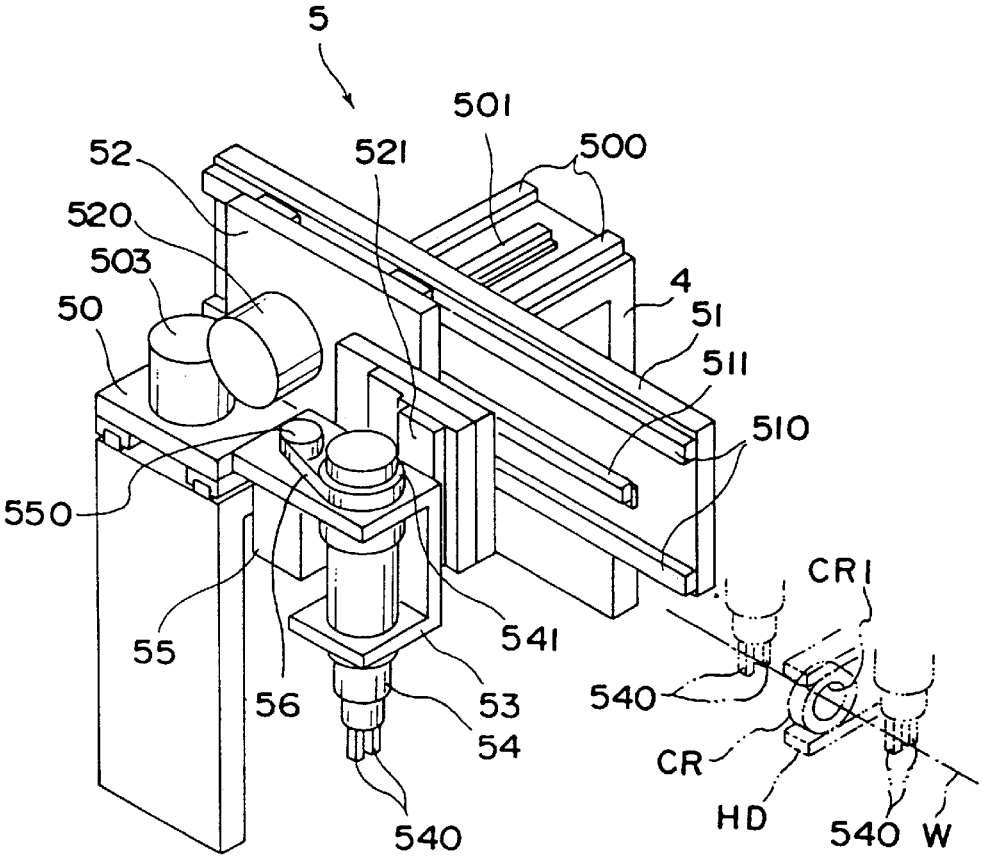
FIG. 2 is a perspective view mainly showing a feed chuck mechanism in the winding apparatus of the first embodiment.
Figure 3:
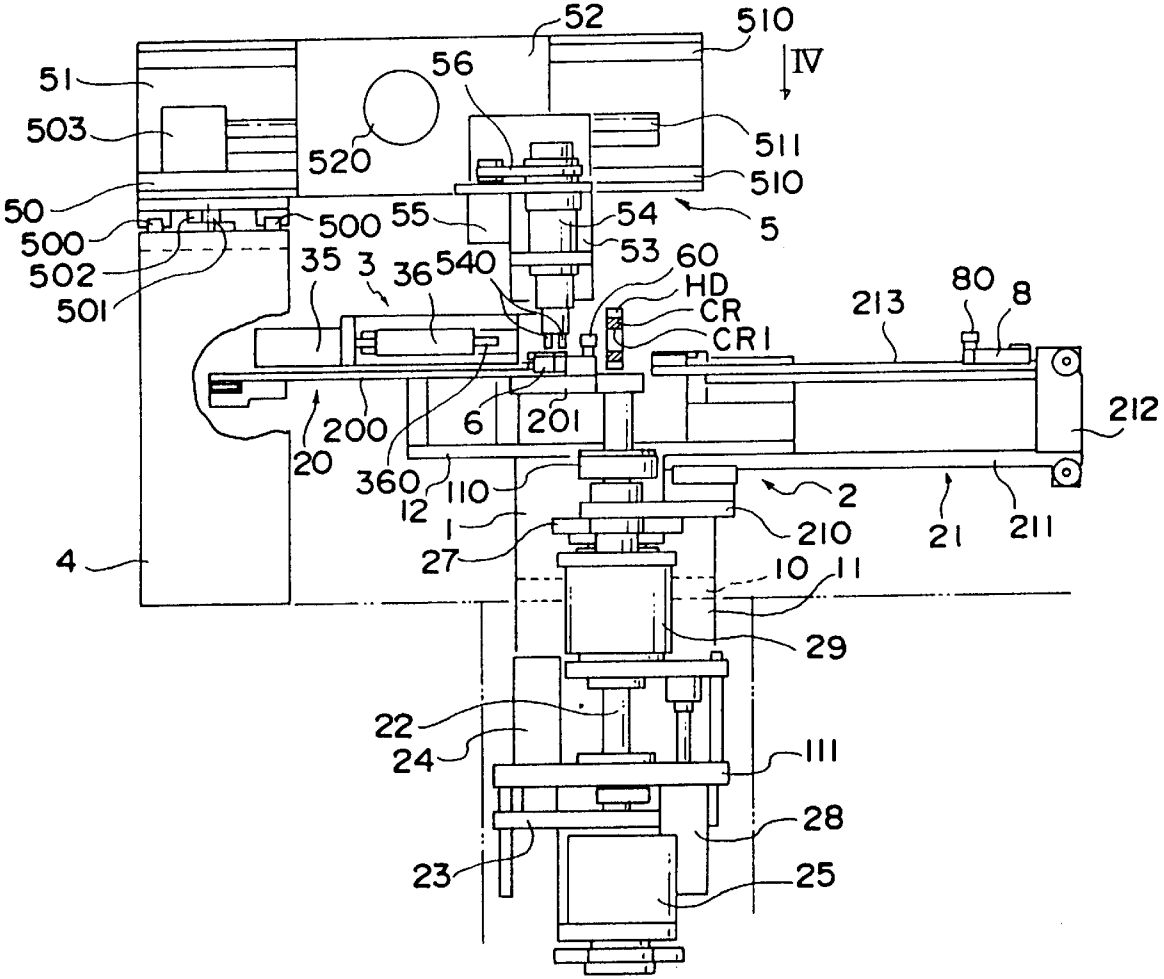
FIG. 3 is a front view of the winding apparatus of the first embodiment viewed from the arrow III direction in FIG. 1.
Figure 4:
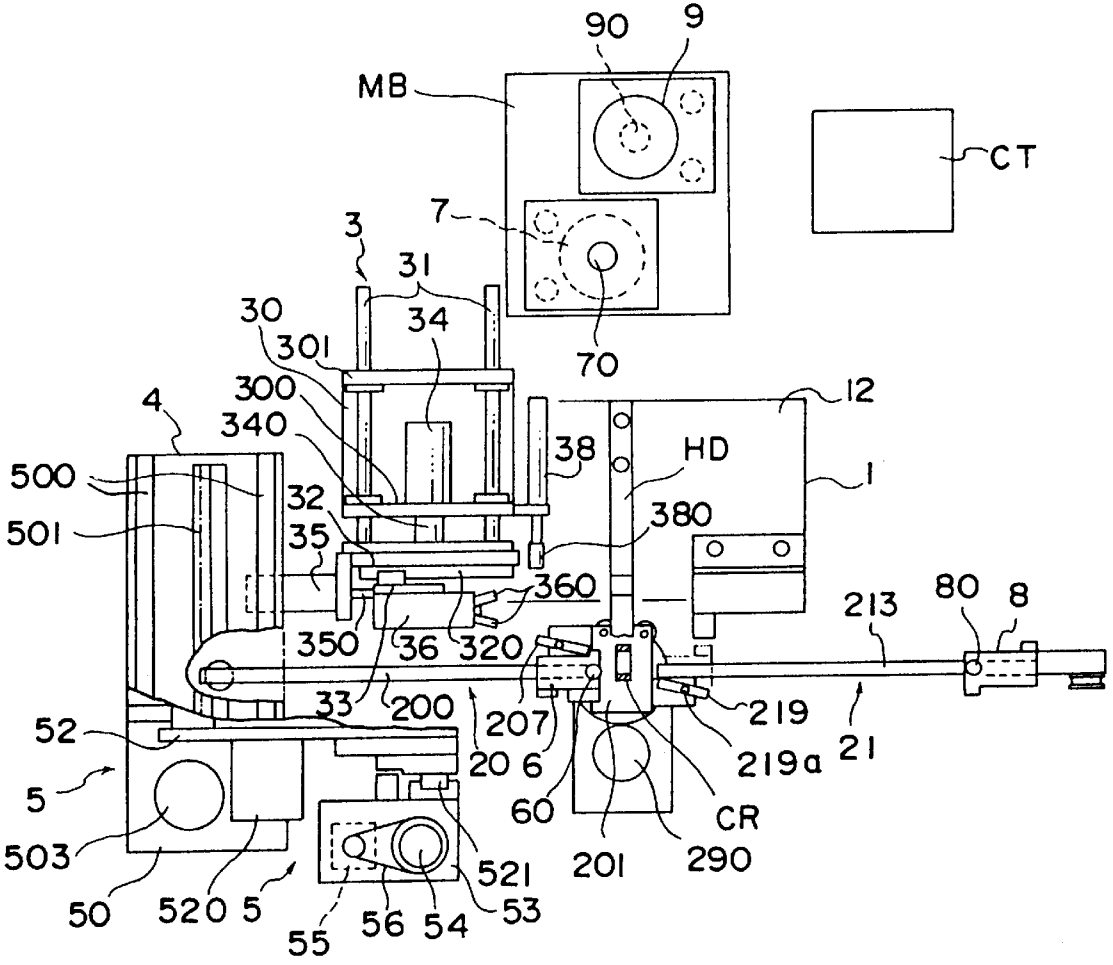
FIG. 4 is a top view of the winding apparatus of the first embodiment viewed from the arrow IV direction in FIG. 3.

Referring now to FIGS. 1 through 10, the first embodiment of the present invention will be described. FIGS. 1 and 2 are perspective views showing the schematic structure of the winding apparatus according to the first embodiment. FIG. 3 is a front view of the winding apparatus viewed from the arrow III direction shown in FIG. 1. FIG. 4 is a top view of the winding apparatus viewed from the arrow IV direction in FIG. 3. The vertical and transverse directions of FIG. 3 correspond to those of the winding apparatus, respectively. The vertical direction of FIG. 4 corresponds to the front-to-rear direction of the winding apparatus. The front side of the winding apparatus is located in the lower part of FIG. 4. As shown in FIGS. 1 to 4, in this first embodiment of the present invention, an arm mechanism 2 and a pull-out chuck mechanism 3 are mounted on the first base 1. A feed chuck mechanism 5 is mounted on the second base 4. An annular-type core CR which is to be winded, is held by a core holder HD near axis of rotation of arms 20 and 21 so that the axial direction of the core CR is aligned with the transverse direction of the winding apparatus. The arms 20 an 21 will be described later. In FIG. 1, only certain parts of the feed chuck mechanism 5 are shown by two-dot chain lines. The arm mechanism 2 and the pull-out chuck mechanism 3 are not shown in FIG. 2.

Figure 5:
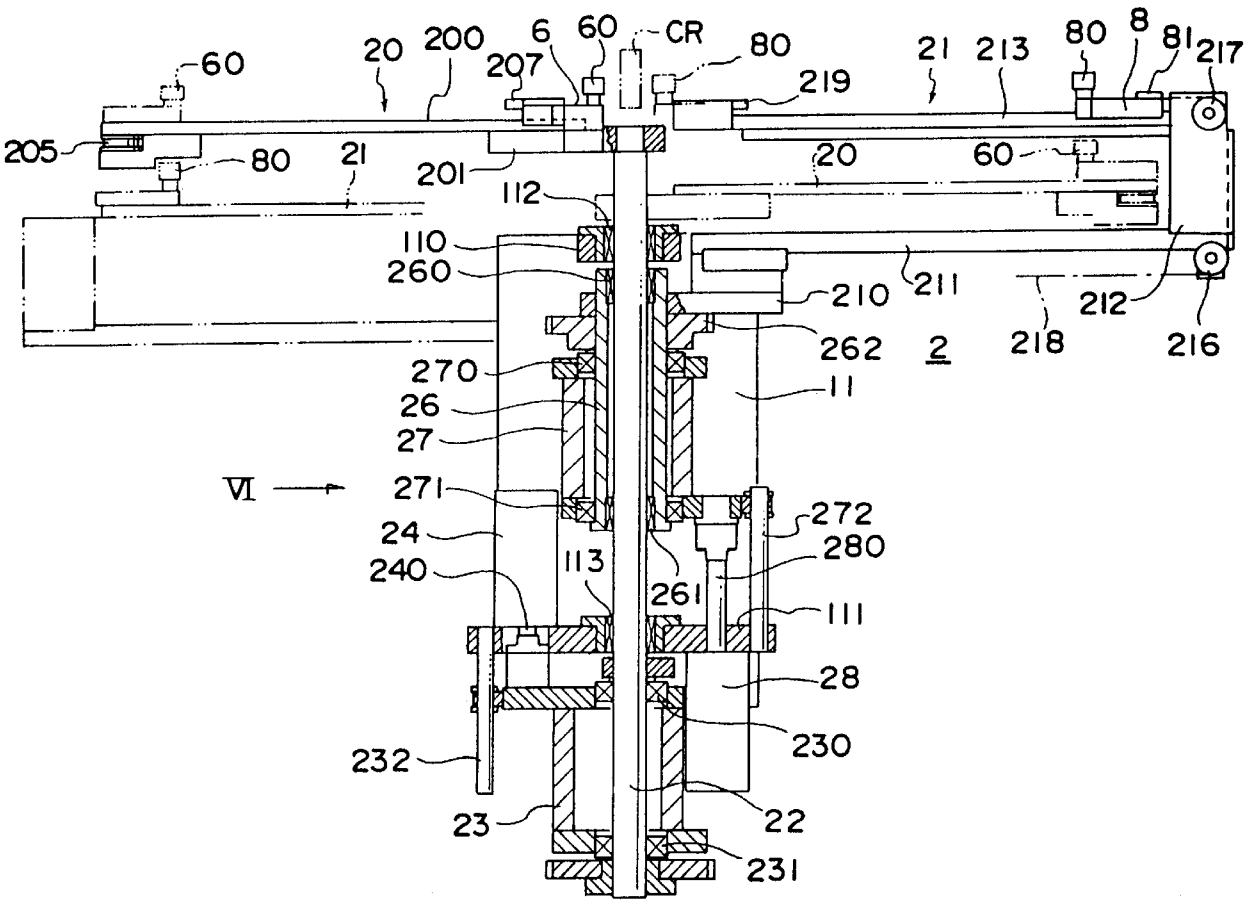
FIG. 5 is a cross sectional view of the arm mechanism in the winding apparatus of the first embodiment.
Figure 6:
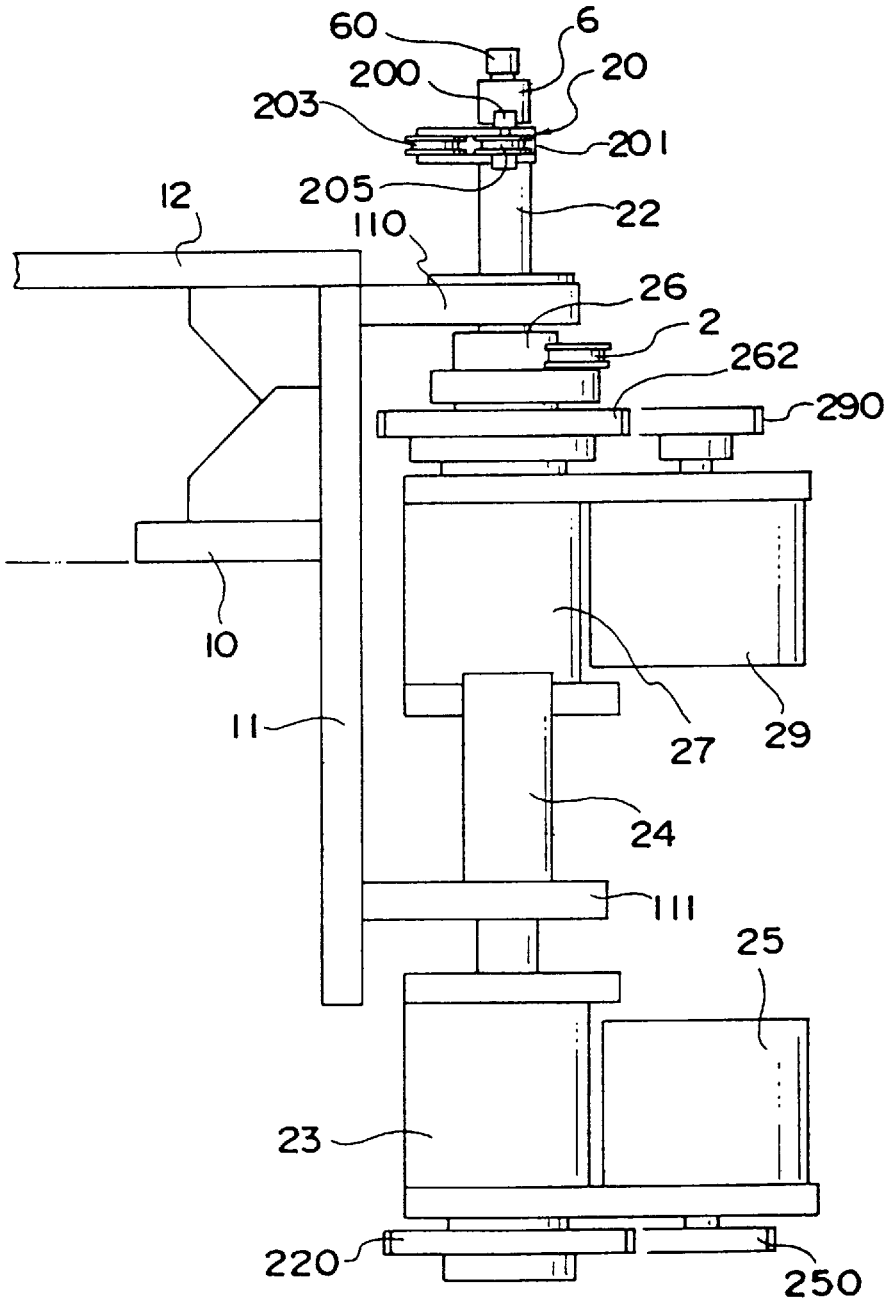
FIG. 6 is a side view of the arm mechanism of the first embodiment taken from the arrow VI direction in FIG. 5.

The arm mechanism 2 has the first arm 20 and the second arm 21 (generally referred to as arms 20 and 21), and an equipment rotating the arms 20 and 21 around the core CR horizontally and moving them up and down. FIGS. 5 and 6 also show the detail of the arm mechanism 2. FIG. 5 is a cross sectional view, which includes the swivel axis of the arms 20 and 21 and is parallel to the axis of the core CR. FIG. 6 is a side view taken from the arrow VI direction in FIG. 5. The first base 1 will be described before the explanation of the arm mechanism 2. The first base 1 comprises a stationary plate 10 fixed horizontally on a mounting base (e.g., a surface plate), a vertical plate 11 fixed vertically at the front end of the stationary plate 11, and a horizontal plate 12 extending backward and horizontally from the top of the vertical plate 11. An upper support plate 110 and a lower support plate 111 are attached to the vertical plate 11 to support the arm mechanism 2. The upper and lower support plates 110 and 111 extend forward and horizontally from the vertical plate 11.

The arm mechanism 2 has the following constructions to rotate the first arm 20 and move it up and down. A rotating shaft 22 is attached to the upper support plate 110 and to the lower support plate 111 through bearings 112 and 113 in such a way that the rotating shaft 22 can move vertically and rotate on its own axis. A movable block 23 is mounted to the bottom of the rotating shaft 22 via bearings 230 and 231 in such a way that the movable block 23 can rotate relatively to the rotating shaft 22 and move vertically with the rotating shaft 22. The movable block 23 is connected to the piston rod 240 of an air-cylinder 24 fixed on the lower support plate 111, and guided vertically by a guide rod 232 fixed to the lower support plate 111. A motor 25 is fixed to the movable block 23 (FIG. 6). A pinion gear 250 which is attached to the output shaft of the motor 25 engages with a gear 220 fixed to the bottom of the rotating shaft 22. The first arm 20 is fixed to the top of the rotating shaft 22. Upon the actuation of the air-cylinder 24, therefore the movable block 23, the rotating shaft 22, and the first arm 20 are moved up and down as a unit. In addition, the rotating shaft 22 and the first arm 20 can be rotated by the motor 25 no matter what vertical position the rotating shaft 22 is in.

The arm mechanism 2 also has the following constructions to rotate the second arm 21 and move it up and down. A hollow cylindrical middle shaft 26 is fit on the rotating shaft 22 between the upper support plate 110 and the lower support plate 111 via bearings 260 and 261 in such a way that the middle shaft 26 can rotate relatively to the rotating shaft 22. A movable block 27 is attached to the outer periphery of the hollow cylindrical middle shaft 26 via bearings 270 and 271 in such a way that the movable block 27 can rotate relatively to the middle shaft 26 and move vertically with the middle shaft 26. The movable block 27 is connected to the piston rod 280 of an air-cylinder 28 fixed on the lower support plate 111, and guided vertically by a guide rod 272 fixed on the lower support plate 111. A motor 29 is fixed to the movable block 27 (FIG. 6). A pinion gear 290 attached to its output shaft (not shown in FIGURES) engages with a gear 262 fixed to the top of the middle shaft 26. The second arm 21 is fixed to the top of the middle shaft 26. Upon the actuation of the air-cylinder 28, therefore the movable block 27, the middle shaft 26 and the second arm 21 are elevated as a unit. In addition, the middle shaft 26 and the second arm 21 can be rotated by the motor 29 regardless of the vertical position of the middle shaft 26. In FIG. 5 solid lines indicate the rotating shaft 22 and the middle shaft 26 in their highest positions. Two dot chain lines indicate the rotating shaft 22 and the middle shaft 26 whose positions are their lowest and rotated by 180 degrees from the positions shown by the solid lines.

As shown in FIGS. 1 and 5, the first arm 20 has a rail 200 extending in the radial direction of the rotating shaft 22. The center end (an end of the arm closer to the swivel axis) of the rail 200 is fixed to the rotating shaft 22 by a connection plate 201. A movable slider 6 can move in the longitudinal direction of the rail 200 and is attached on the rail 200. A roller 60 which can rotate around its vertical axis is attached on the top of the slider 6. The axis position of the roller 60 is offset forward (downward in FIG. 4) from the axis of the core CR held in the core holder HD. When the first arm 20 is in its highest position, the roller 60 and the axis of the core CR are about the same height.

Figure 7:
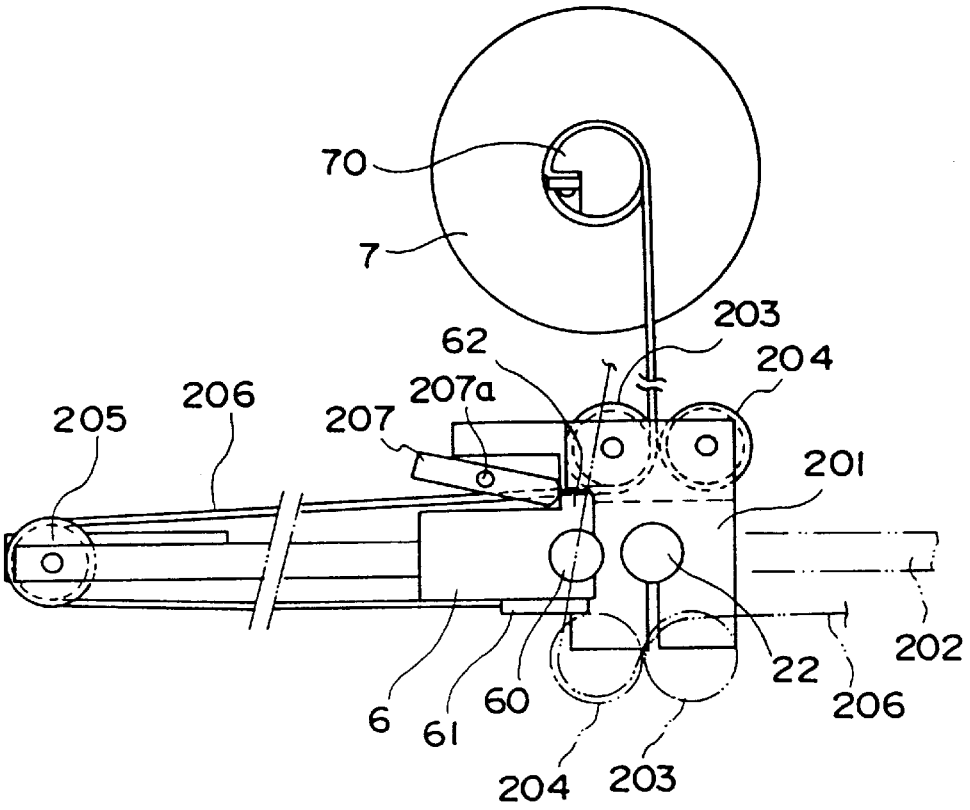
FIG. 7 is a top view showing tension apply means on the first arm of the first embodiment.

As shown in detail in FIG. 7, pulleys 203, 204, and 205 are attached to the top surface of the connection plate 201 and the outer end of the rail 200 (left end in FIG. 7). A belt 206 engages pulleys 203, 204, and 205. One end of the belt 206 is pulled out from the pulley 205 toward the center end of the first arm 20, and secured by a hold-down plate 61. The hold-down plate 61 is fixed to the slider 6 by some fixing means such as bolts. In FIG. 1, the belt 206 is indicated by dashed lines. The other end of the belt 206 is pulled out from the pulleys 203 and 204 toward the rear of the winding apparatus, and fixed to the output shaft 70 of a torque motor 7. In the torque motor 7, rotational torque of the output shaft 70 can be adjusted according to the signal from the controller CT shown in FIG. 4.

As shown in FIG. 1, FIGS. 4, and 7, a stop lever 207 which can swing around an axis 207*a*, is installed on the center end of the rail 200. The stop lever 207 receives rotational torque from a spring not shown in the figures, in such a way that one end of the stop lever 207 near the rotating shaft 22 protrudes into the traveling path of the slider 6. When the slider 6 reaches the center end of the rail 200, a projection 62 of the slider 6 is engaged with the stop lever 207 so that the reverse movement of the slider 6 toward the outer end (opposite side to the rotating shaft 22) is inhibited. The stop lever 207 rotates around the rotating shaft 22 together with the rail 200.

As shown in FIGS. 1 and 5, the second arm 21 has a shaft connection plate 210 fixed to the middle shaft 26, a rail support rod 211 extending from the shaft connection plate 210 in the radial direction of the middle shaft 26, a vertical connection plate 212 which is installed to extend from the outer end of the rail support rod 211, and a rail 213 which extends from the top of the vertical connection plate 212 toward the rotating shaft 22 and is parallel to the rail support rod 211. The positions of the rail support rod 211, the vertical connection plate 212, and the rail 213 are determined such that when the second arm 21 is raised and the first arm 20 is lowered, the first arm 20 can pass through the empty space surrounded by members 211, 212, and 213, as indicated by two-dot chain lines in FIG. 5. A movable slider 8 which can move in the longitudinal direction of the rail 213, is attached on the rail 213. A roller 80 which can rotate around its vertical axis is attached to the top of the slider 8. The position of the axis of this roller 80 is offset forward (downward in FIG. 4) from the axis of the core CR held in the core holder HD in the same manner as for the roller 60 of the first arm 20. When the first arm 20 and the second arm 21 are both in their highest positions, the roller 60 and the roller 80 are at the same level.

Figure 8:
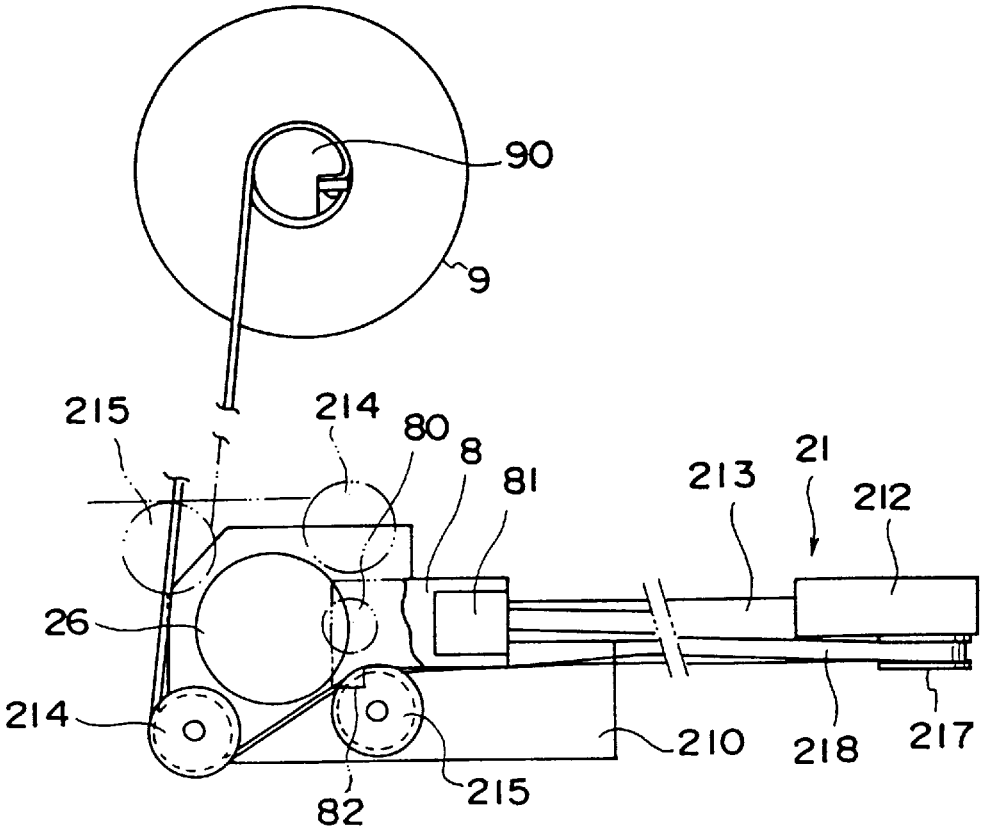
FIG. 8 is a top view showing tension apply means on the second arm of the first embodiment.

As shown in FIGS. 1, 5, and 8, a pair of pulleys 214 and 215 is attached to the top face of the shaft connection plate 210. A pair of pulleys 216 and 217 is attached to the side face of the vertical connection plate 212. A belt 218 engages pulleys 214, 215, 216, and 217. One end of the belt 218 is pulled out from the pulley 217, and secured on the top face of the slider 8 by a hold-down plate 81. In FIG. 1, the belt 218 is indicated by dashed lines. The other end of the belt 218 is pulled out from the pulleys 214 and 215 toward the rear side of the winding apparatus, and fixed to the output shaft 90 of a torque motor 9. In the torque motor 9, rotational torque of the output shaft 90 alters according to the signal from a controller CT shown in FIG. 4. Rotational torque of the output shaft 90 is set independent of that for the torque motor 7.

As shown in FIGS. 1 and 4, in the second arm 21, a stop lever 219 which can swing about an axis 219*a*, is installed on the center end of the rail 213 in the similar manner to the first arm 20. The stop lever 219 receives rotational torque from a spring not shown in the figures in such a way that one end of the stop lever 219 near the rotating shaft 22 protrudes into the traveling path of the slider 8. When the slider 8 reaches the center end of the rail 213, a projection 82 of the slider 8 (FIG. 8) is engaged with the stop lever 219 so that the reverse movement of the slider 8 toward the outer end (opposite side to the rotating shaft 22) is inhibited.

A pair of pulleys 203 and 204 and a pair of pulleys 214 and 215 are installed to the connection plate 201 and the shaft connection plate 210, respectively to prevent the belts 206 and 218 from getting out of the central region of rotation even when the arms 20 and 21 swivel by 180 degrees as described by two-dot chain lines in FIGS. 7 and 8, respectively. Each of torque motors 7 and 9 is, for example, fixed to a motor bracket MB mounted on the rear side of the first base 1 (upper side in FIG. 4) such that the motors are reversed vertically to each other.

As shown in FIGS. 1, 3, and 4, the pull-out chuck mechanism 3 has a guide block 30 fixed to a horizontal plate 12 (FIG. 6) of the first base 1, a pair of rods 31 which are supported by front- and back- vertical plates 300 and 301 of the guide plate 30 and capable of moving forward and backward, a back-and-forth slider 32 fixed to the front end of the rods 31, a right-and-left slider 33 which is installed on a rail 320 of the back-and-forth slider 32 and is movable to the right and left, an air-cylinder 34 which moves the back-and-forth slider 32 back and forth, an air-cylinder 35 which moves the right-and-left slider 33 to the right and left, and an air chuck 36 mounted on the right-and-left slider 34. The air chuck 36 has a pair of claws 360 which open or close according to the supply or release of compressed air. The position of the claws 360 is adjusted in advance to the same height as the axis of the core CR. Also, when the piston rod 350 of the air-cylinder 35 extend, the claws 360 reach just front of the center hole CR1 (FIG. 3) of the core CR.

An air-cylinder 38 is fixed to one of the side edges of the vertical plate 300 of the guide block 30. When a piston rod 380 of the air-cylinder 38 extends, the tip of the piston rod 380 pushes and rotates the stop lever 207. As a consequence, the stop lever 207 releases the slider 6. When the positions of the first arm 20 and the second arm 21 are interchanged, the stop lever 219 is similarly pushed and the slider 8 is released.

As shown in FIGS. 1 to 4, especially in FIG. 2 for details, the feed chuck mechanism 5 has a back-and-forth slider 50 attached on the top face of a second base 4, an arm 51 integrated with the back-and-forth slider 50, a right-and-left slider 52 attached on the front face of the arm 51, an up-and-down slider 53 attached on the front side of the right-and-left slider 52, an air chuck 54, and a motor 55. The air chuck 54 and the motor 55 are attached to the up-and-down slider 53. A pair of rails 500 are installed on the top face of the second base 4. The back-and-forth slider 50 is supported on the second base 4 by the rails 500 in such a way that the back-and-forth slider 50 can move back and forth along the pair of rails 500. In parallel with the rails 500, a rack 501 is fixed to the top face of the second base 4. A motor 503 rotates a pinion gear 502 (FIG. 3). The pinion gear 502 is engaged with the rack 501. Accordingly the back-and-forth slider 50 moves in the backward or forward direction of the winding apparatus.

In the front face of the arm 51, A pair of rails 510 and a rack 511 extend in the right-and-left direction and are fixed on the front face of the arm 51. A right-and-left slider 52 is supported by the arm 51 such that it can move to the right or left along the rails 510. A motor 520 fixed to the right-and-left slider 52 rotates a pinion gear (not shown in the figures) which engages with the rack 511. Accordingly the right-and-left slider 52 moves to the right and left. The up-and-down slider 53 is supported on the right-and-left slider 52 in such a way that it can move along a rail 521 fixed on the front face of the right-and-left slider 52, and is driven up and down by an air-cylinder which is not shown in the figures. Like the pull-out mechanism 3, the air chuck 54 has a pair of claws 540 which open and close according to the supply and release of compressed air. The air chuck 54 is supported by the up-and-down slider 53 in such a way that it can rotate on its vertical axis. At the top of the air chuck 54, a pulley 541 is attached. A pulley 550 is attached to the output shaft (not shown in the figures) of the motor 55. A belt 56 is looped around the pulleys 541 and 550 so that the air chuck 54 can be rotated by the motor 55.

As illustrated by two-dot chain lines in FIG. 2, by combining the above-mentioned back-and-forth movement of the back-and-forth slider 50, lateral movement of the right-and-left slider 52, and vertical movement of the up-and-down slider 53, the claws 540 of the air chuck 54 can hold the wire W, which is inserted into the center hole CR1, on either of the entrance side (front side in FIG. 2) and the exit side of the center hole CR1 of the core CR. Also, as shown by two-dot chained lines in FIG. 1, the claws 540 are held at a position spaced enough from the core CR, when the back-and-forth slider 50 reaches the front end and the right-and-left slider 52 reaches the left end.

Next, the operation will be explained. In the winding apparatus of the present invention, a controller CT (FIG. 4) controls the mechanisms 2, 3, 5, and the torque motors 7 and 9, to wind the wire W according to the steps shown in FIGS. 9 and 10. FIGS. 9 and 10 are horizontal cross sectional view which include the axis of the core CR. The "up" direction of the figures corresponds to the front direction of the winding apparatus. Namely, "up and down" and "right and left" in FIGS. 9 and 10 are reversed with respect to FIG. 4. The left side of the core CR corresponds to the entrance side of the center hole CR1. In FIGS. 9 and 10, the roller 60 (80) represents the arm 20 (21) and slider 6 (8), respectively, the air chuck 36 represents the pull-out chuck mechanism 3, and the air chuck 54 represents the feed chuck mechanism 5 (in some figures, the number which indicates the claws 540 is also shown). Solid lines illustrate the state in which the rollers 60 and 80 are at the same height as the axis of the core CR. Dashed lines illustrate the state in which the rollers 60 and 80 are below the core CR. Although the tip W1 of the wire W is indicated by a black circle to show the tip W1 clearly, no such object is attached in actual winding operation.

Figure 9A:
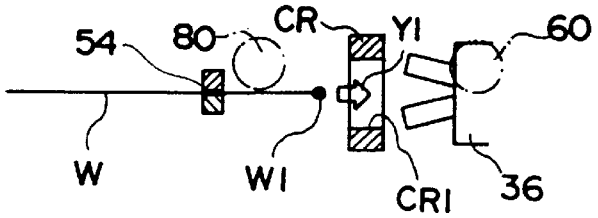
FIGS. 9A through 9E and 10A through 10E show the winding steps of the winding apparatus of the first embodiment.

At the beginning of winding, the wire W is fed from a wire-supply which is not shown in the figure, toward the core CR as shown in FIG. 9A. In response to the supply of wire W, the air chuck 54 moves to the entrance side of the center hole CR1, and holds the wire W at the position slightly withdrawn from tip W1. At this time, the rollers 60 and 80 move down below the core CR, and are constrained by stop levers 207 and 219 (FIG. 4) at the center ends of arms 20 and 21. At the beginning of the winding, either arm 20 or 21 may be placed on the exit side of the center hole CR1. In the following explanation, the first arm 20 is initially placed on the exit side.

Figure 9B:
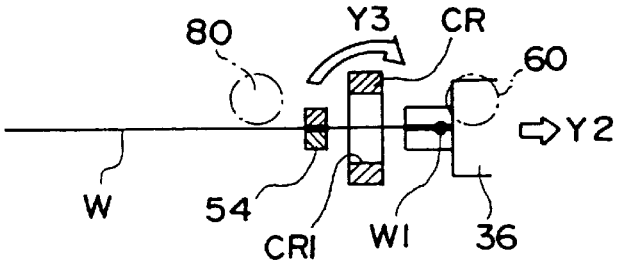

After holding wire W, the air chuck 54 moves toward the center hole CR1 and the wire W is inserted into the center hole CR1 as shown by an arrow Y1. In response to the insertion of wire W, the air chuck 36 advances toward the center hole CR1, and holds the tip W1 of the wire W which has passed through the center hole CR1 as shown in FIG. 9B. Then the air chuck 36 moves along the axis of the core CR in the direction away from the core CR as shown by an arrow Y2. Accordingly, the wire W is pulled out from the center hole CR1. At this time, the wire W is tensioned straight in the region between air chucks 54 and 36, and is straightened. Then, the air chuck 54 moves over to the exit side of the center hole CR1 as shown by an arrow Y3.

Figure 9C:
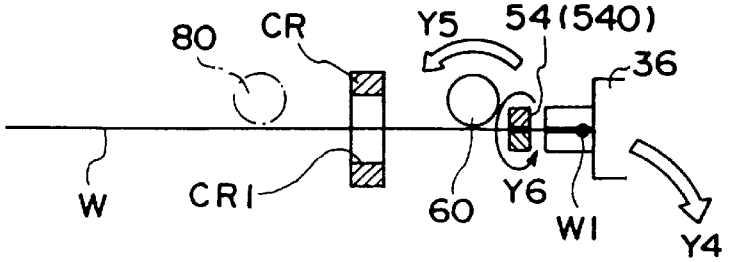
Figure 9D:
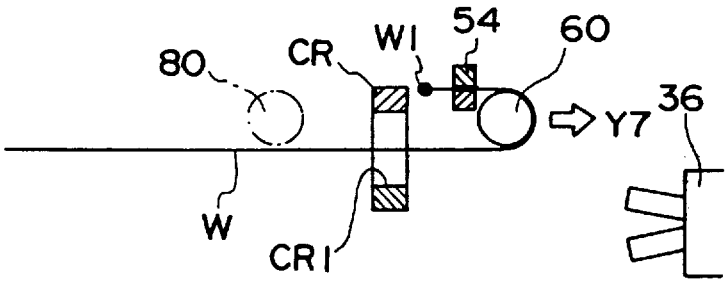

The air chuck 54 re-grips the wire W behind the holding position of the air chuck 36 as shown in FIG. 9C. The air chuck 36 moves away from the core CR releasing the wire W as shown by an arrow Y4. Since the wire W is pulled out straight before re-gripped, it is not necessary to install a rod-type jig to wire W. At the same time that the air chuck 36 moves backward, the roller 60 moves upward through the elevation of the first arm 20 (FIG. 1), and reaches the same height as that for the core CR. Next, the air chuck 54 moves around the roller 60 as shown by an arrow Y5, so that the wire W is wound around the roller 60 as shown in FIG. 9D. During this motion, the claws 540 rotate on their axis in the arrow Y6 direction. In this state, the torque motor 7 shown in FIGS. 4 and 7 starts giving the rotational torque to the output shaft 70 in the direction to winch a belt 206. As a consequence, the roller 60 receives the force in the direction away from the core CR. The stop lever 207 releases the slider 6 by engaging with the extended piston rod 380 of the air-cylinder 38 which is shown in FIGS. 1 and 4. Then, the roller 60 moves away from the core CR as shown by an arrow Y7 in FIG. 9D and pulls out the wire W toward the exit side of the center hole CR1.

Figure 9E:
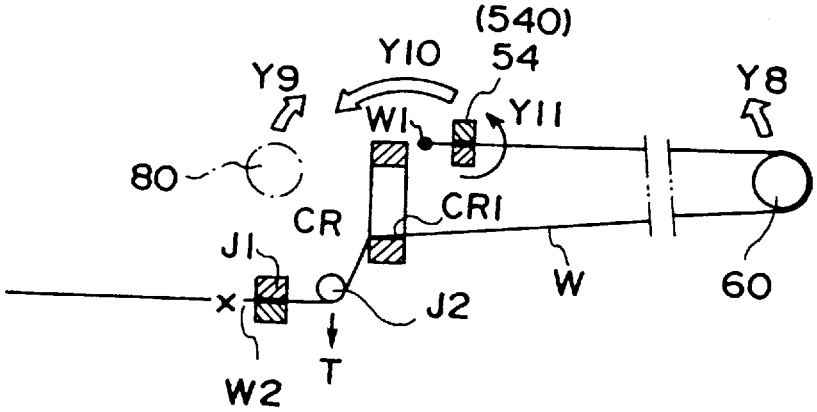

When the required length of the wire W is pulled out to the exit side of the center hole CR1, the above-mentioned wire-supply stops providing the wire W. As shown in FIG. 9E, a holder J1 grips the wire W near the end W2, and the excess wire is clipped off. The resulting length between the tip W1 and the end W2 of the wire W is slightly longer than the necessary length to wind the core CR required times. When both the tip W1 and the end W2 of the wire W are gripped in this manner, the wire W which winds around the roller 60 receives the tension corresponding to the rotational torque of the torque motor 7 (FIG. 7). Here, it is preferable to have an apparatus such as rod J2 which stretches the wire W in the arrow T direction to prevent slack.

Figure 10A:
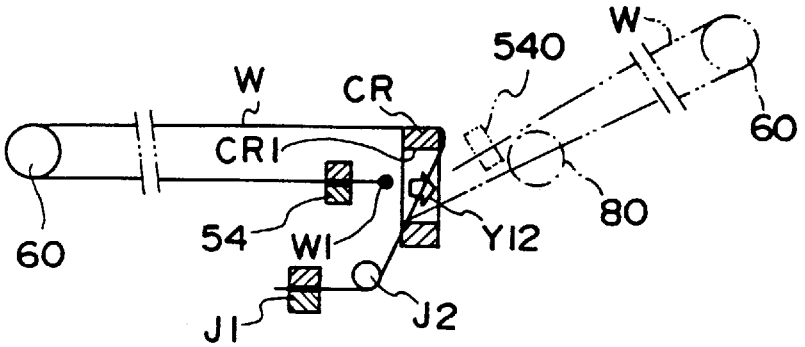

After reaching the step shown in FIG. 9E, the arms 20 and 21 swivel in the opposite direction to each other as shown by arrows Y8 and Y9. The positions of rollers 60 and 80 are interchanged as shown in FIG. 10A. While the arms 20 and 21 swivel, the air chuck 54 returns to the opposite side of the core CR as shown by an arrow Y11 in FIG. 9E. At the same time, the claws 540 rotate on their axis by 180 degrees as shown by an arrow Y11 in FIG. 9E in the same direction as the roller 60 swivels. Therefore, the roller 60 and the claws 540 swivel around the core CR as a unit, preventing the wire W from bending at the holding position of claws 540.

Figure 10B:
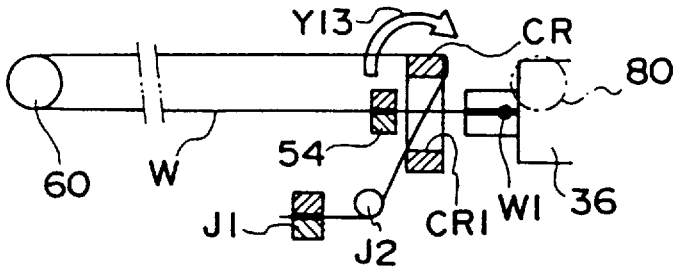
Figure 10C:
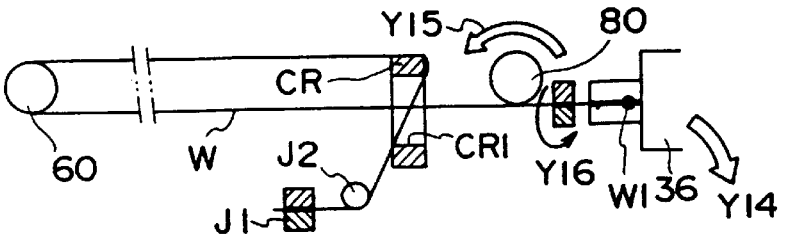
Figure 10D:
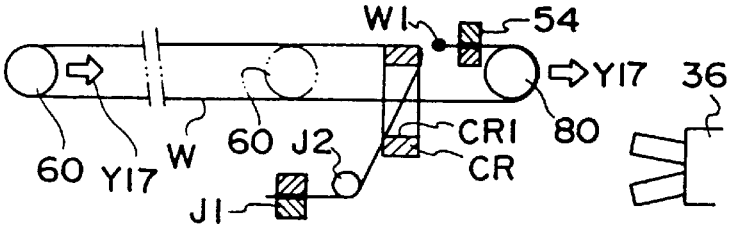

As shown in FIG. 10A, when the rollers 60 and 80 interchange their position, the wire W is wound on the core CR. The tension provided by the roller 60 winds the wire W closely on the core CR. The second turn of winding is initiated by the air chuck 54 moving toward the core CR and inserting the wire W into the center hole CR1 as shown by an arrow Y12. The air chuck 36 holds the tip W1 of the wire W which passes through the center hole CR1 as shown in FIG. 10B. At this time, the wire W is again straightened. Then, the air chuck 54 moves over to the opposite side of the core CR as shown by an arrow 13. The air chuck 54 re-grips the wire W behind the holding position of the air chuck 36 as shown in FIG. 10C. The air chuck 36 moves backward releasing the wire W as shown by an arrow Y14. The roller 80 moves upward. The air chuck 54 moves around the roller 80 in the manner shown by an arrow Y15. At the same time, the claws 540 rotate on their axis in the arrow 16 direction. In such a way, the wire W is wound around the roller 80 as shown in FIG. 10D. In this state, the torque motor 9 shown in FIGS. 4 and 8, starts giving the rotational torque to the output shaft 90 in the direction to winch a belt 218. At the same time, the rotational torque in the direction winching a belt 206 is given to the output shaft 70 of the torque motor 7 in FIG. 7. The rotational torque of the output shaft 90 is set larger than that of the output shaft 70.

Figure 10E:
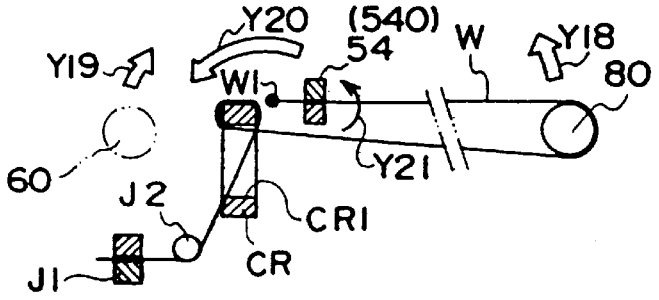

Then, the piston rod 380 of the air-cylinder 38 shown in FIGS. 1 and 4 extends, and the stop lever 219 releases the slider 8. The roller 80 tugs the wire W stronger than the roller 60, since the output torque of the torque motor 9 is set larger than that of the torque motor 7. Therefore, the rollers 60 and 80 move in the arrow Y17 direction. The arm 20 moves downward when the roller 60 reaches center end as shown by two-dot chain lines in FIG. 10D. Accordingly the wire W is handed over to the core CR as shown in FIG. 10E. During this operation, the roller 80 keeps tensioning the wire W in the direction away from the core CR. Therefore, when the roller 60 removes downward, the wire W does not slack. Whether the roller 60 reaches its center end can be detected by a detector such as proximity switches.

As shown in FIG. 10E, when the roller 60 moves downward, the roller 80 (corresponding to the roller 60 in FIG. 9E) on the exit side of the center hole CR1 pulls out wire W. After this step, the arms 20 and 21 swivel in the opposite direction with each other as shown by arrows Y18 and Y19. While the arms 20 and 21 swivel, the air chuck 54 returns to the opposite side of the core CR, and the claws 540 rotate on their axis in the same direction as the roller 80 swivels by 180 degrees as shown by an arrow Y21. Therefore, the roller 80 and the claws 540 swivel around the core CR as a unit, preventing the wire W from bending at the holding position of claws 540. As a consequence, the winding apparatus reaches the state in FIG. 10A but the rollers 60 and 80 are interchanged. The winding apparatus winds the wire W alternating the rollers 60 and 80, by repeating the steps of FIGS. 10A through 10E. Here, the output torque of the torque motors 7 and 9 are exchanged in accordance with interchanging the rollers 60 and 80. After each round of the wire W winding, the core CR rotates on its axis by the prescribed angle (the angle corresponding to one pitch of the helical coil wound on the core CR).

Although the wire W is re-gripped by the same air chuck 54 on the exit side of the center hole CR1 in the above-mentioned embodiment, it is possible to have an alternative feed chuck specially assigned to insert the wire W on the entrance side of the center hole CR1. In this case, the pull-out chuck on the exit side is capable of moving around the core CR in the same manner as the air chuck 54, so that the wire W is re-gripped on the entrance side of the center hole CR1. Also, hoist members such as wire and chain may be used instead of the belts 206 and 218.

Second Embodiment

Referring now to FIGS. 11 through 14E, the second embodiment of the present invention will be described. In FIGS. 11 through 14E, the same reference numerals are assigned to the same members as those in FIGS. 1 to 10.

Figure 11:
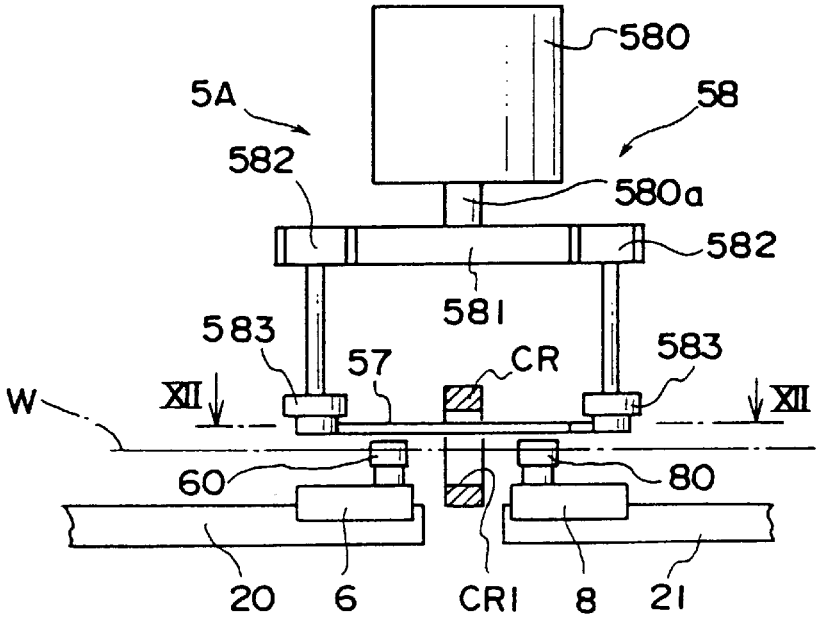
FIG. 11 shows a schematic view of the winding apparatus of the second embodiment of the present invention.
Figure 12:
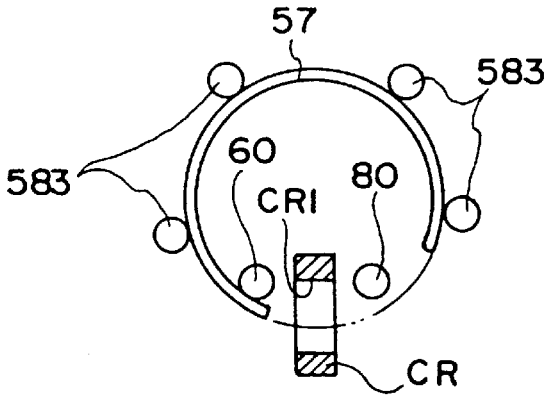
FIG. 12 is a cross sectional view taken on line XII—XII of FIG. 11.

As shown in FIGS. 11 and 12, the winding apparatus of the present embodiment dose not have the pull-out chuck mechanism 3 and the feed chuck mechanism 5 of the first embodiment described above. Instead, a circular arc ring mechanism 5A is provided as insertion and bring back means for wire. The circular arc ring mechanism 5A includes a drive unit 58 and a circular arc ring 57 which is shaped so that a small part of circle is removed. Through gears 581 and 582, the drive unit 58 transfers the torque of the output shaft 580*a* of a motor 580 to a plurality of rollers 583. The rollers 583 located at the periphery of the circular arc ring 57 and engages with the circular arc ring 57. Accordingly the drive unit 58 can swivel the circular arc ring 57 horizontally on the axis of the circular arc ring 57.

Figure 13A:
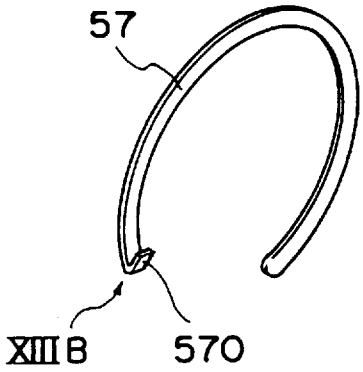
FIGS. 13A and 13B illustrate a circular arc ring in the second embodiment in detail.
Figure 13B:
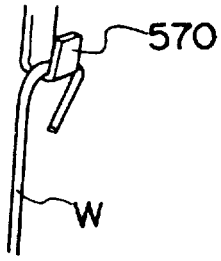

A central hole CR1 of the core CR is located on the circular trajectory of the circular arc ring 57. Also, as is clear from FIG. 12, rollers 60 and 80 come inside the circular arc ring 57 when the rollers 60 and 80 reach the center ends. As shown in FIG. 13A, the circular arc ring 57 has a hook 570 on the back (side facing the bottom of FIG. 11) of one end of the circular arc ring 57. As shown in FIG. 13B, the wire W can be fixed on the circular arc ring 57 when the wire W is hooked on the hook 570 and pulled. The winding apparatus of the present embodiment also has an arm mechanism 2, accompanying sliders 6 and 8, and torque motors 7 and 9. However the detailed illustrations of these components are omitted, since these components are common to the first embodiment. As shown in FIG. 11, vertical positions of the circular arc ring 57 and the rollers 583 are determined not to interfere with the wire W which is to be inserted in the core CR.

FIGS. 14A through 14E show winding steps for the winding apparatus of the present embodiment. As in FIGS. 9 and 10, solid lines illustrate the rollers 60 and 80 at the same height as the axis of the core CR (in the state shown in FIG. 11). Dashed lines illustrate the rollers 60 and 80 withdrawn below the core CR. In FIGS. 14A through 14E, the left side of the center hole CR1 corresponds to the entrance side of the wire W.

Figure 14A:
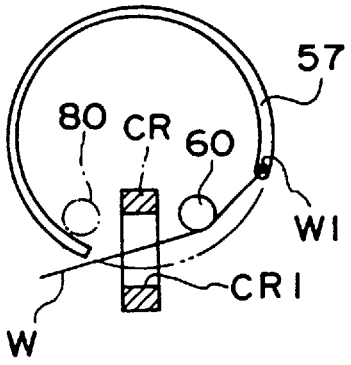
FIGS. 14A through 14E show the winding steps in the winding apparatus of the second embodiment.
Figure 14B:
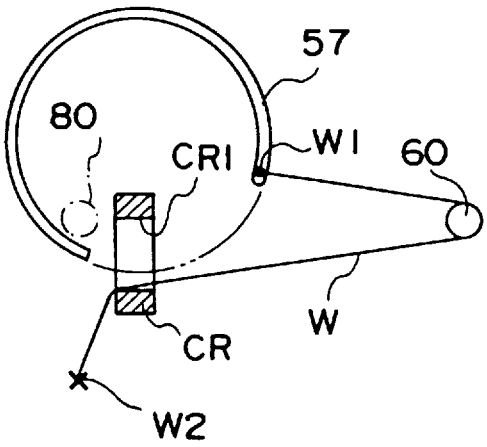
Figure 14C:
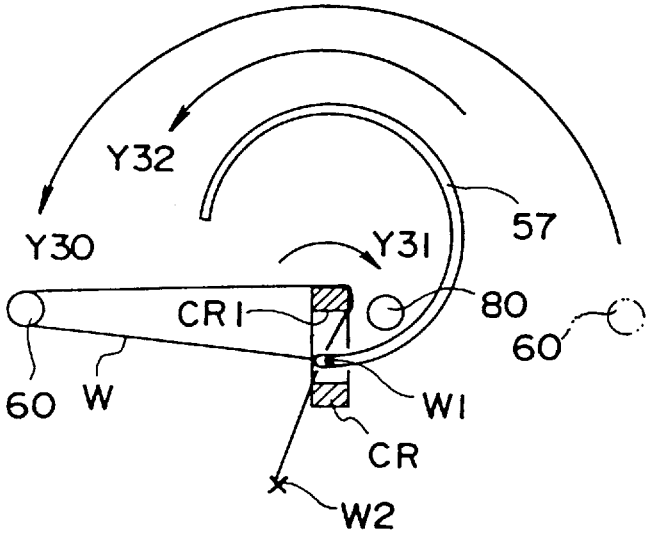

FIG. 14A shows the beginning state of winding. At the beginning state, the wire W is inserted into the center hole CR1 and is wound around the roller 60 (or roller 80) on the exit side of the center hole CR1. The wire W near the tip W1 is attached to the hook 570 (FIGS. 13A and 13B) of the circular arc ring 57. For example, the following steps achieve this state; rotating the circular arc ring 57 so that the hook 570 appears on the entrance side of the center hole CR1, attaching the wire W on the hook 570, and rotating the circular arc ring counterclockwise up to the position shown in FIG. 14A. After the state of FIG. 14A is obtained, the roller 60 moves away from the core CR as shown in FIG. 14B. At this time, the end W2 of the wire W is constrained by an appropriate holder (not shown in the Figure). Next, rollers 60 and 80 swivel in the direction opposite to each other and interchange their positions as shown by arrows Y30 and Y31 in FIG. 14C. At the same time, the circular arc ring 57 rotates by 360 degrees in the same direction as the roller 60. In this case, the roller 60 and the hook 571 swivel synchronously so that the wire W does not bend between the hook 571 and the roller 60.

Figure 14D:
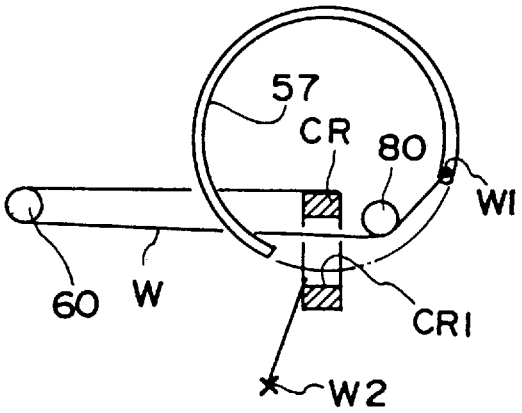
Figure 14E:
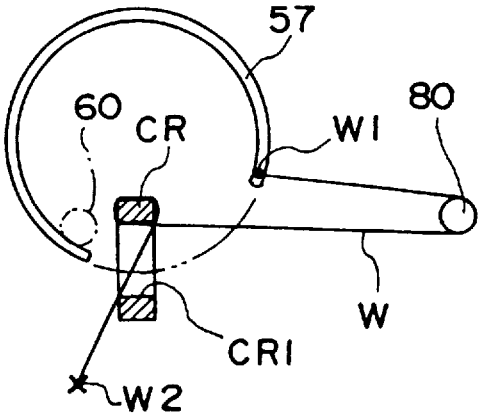
Figure 15:
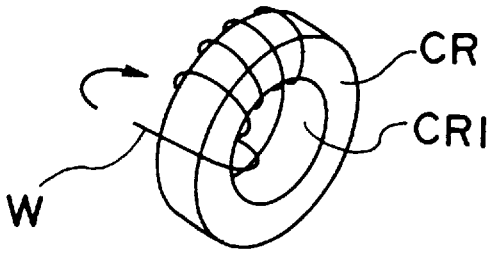
FIG. 15 is a perspective view of a toroidal coil.
Figure 16A:
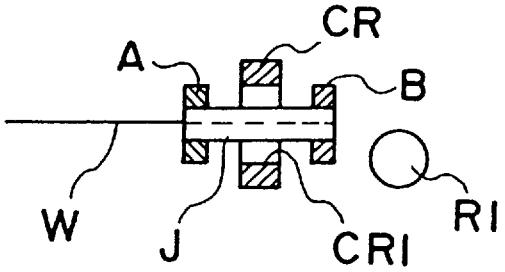
FIG. 16A (PRIOR ART)
FIGS. 16A through 16E show conventional winding steps.
Figure 16B:
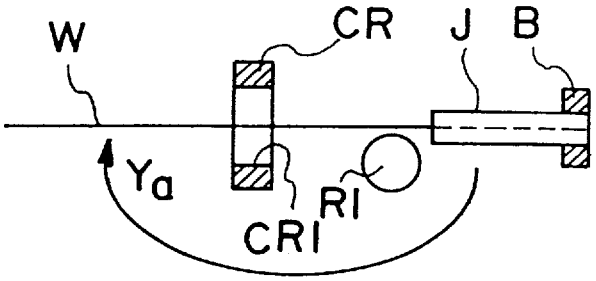
FIG. 16B (PRIOR ART)
Figure 16C:
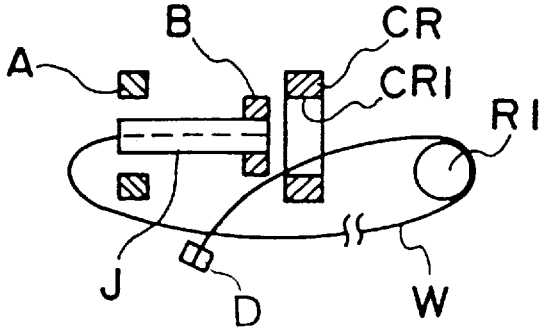
FIG. 16C (PRIOR ART)
Figure 16D:
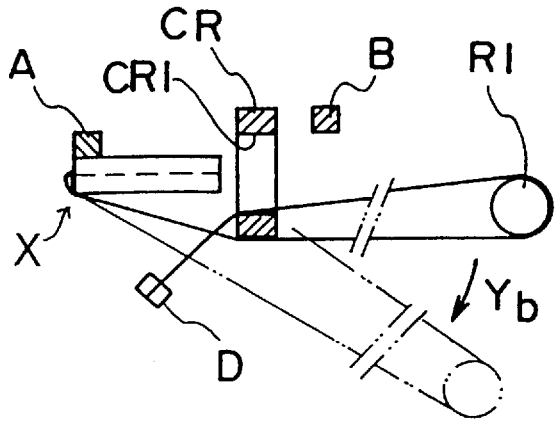
FIG. 16D (PRIOR ART)
Figure 16E:
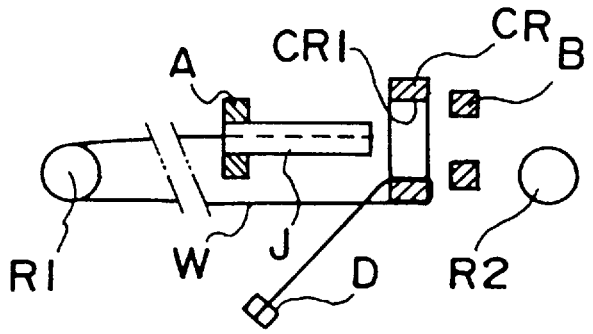
FIG. 16E (PRIOR ART)

When the circular arc ring 57 rotates by 360 degrees and stops, the wire W is inserted into the center hole CR1 and wound around the roller 80 as shown in FIG. 14D. Next, the roller 80 moves away from the core CR and the roller 60 is pulled back to the core CR. Accordingly, the wire W passes through the center hole CR1. When the roller 60 reaches the end of its moving rang near the center of rotation, the roller 60 moves down and the wire W is handed over to the core CR as shown in FIG. 14E. Thus, the wire W is wound on the core CR by one round. The state in FIG. 14E is the same as that in FIG. 14B, except that rollers 60 and 80 interchange their positions. The winding apparatus winds the wire W alternating the rollers 60 and 80 by repeating the steps shown in FIGS. 14B through 14E. After each round of the wire W winding, the core CR rotates on its axis by the prescribed angle (the angle corresponding to one pitch of the helical coil wound on the core CR).

What is claimed is:

1. A toroidal coil winding apparatus for winding a wire on a core comprising:

passing means for passing said wire through a center hole of said core from an entrance side to an exit side of said center hole;

a movable body on which said wire is wound and which is movable in a direction of an axis of said core;

a holding member which holds said wire on said exit side at or near a tip of said wire which has passed to said exit side from said entrance side; and means for bringing said holding member which is holding said wire at said exit side to said entrance side by crossing a path of said movable body on said exit side and moving around said core, wherein said passing means comprises a feed chuck which directly holds said wire at a position withdrawn by a predetermined length from a tip of said wire and inserts said wire into said center hole, and a pull-out chuck which directly grips said wire, which has been inserted into said center hole by said feed chuck, on said exit side and pulls out said wire from said center hole, and wherein said feed chuck is adapted to move around said core between said entrance side and said exit side, works as said holding member, and directly re-grips said wire, which has been pulled out by said pull-out chuck, at a position withdrawn by a predetermined length from a position where said wire is directly held by said pull-out chuck.

2. A toroidal coil winding apparatus as claimed in claim 1, wherein said feed chuck also works as said bringing means.

3. A toroidal coil winding apparatus as claimed in claim 2, further comprising means for tensioning and straightening said wire near said tip by said feed chuck and said pull-out chuck.

4. A toroidal coil winding apparatus for winding a wire on a core comprising:

passing means for passing said wire through a center hole of said core from an entrance side to an exit side of said center hole;

a movable body on which said wire is wound and which is movable in a direction of an axis of said core;

a holding member which holds said wire on said exit side at or near a tip of said wire which has passed to said exit side from said entrance side; and means for bringing said holding member which is holding said wire at said exit side to said entrance side by crossing a path of said movable body on said exit side and moving around said core, wherein said bringing means has swiveling means for swiveling said movable body from said exit side to said entrance side;

rotation means which rotates said holding member on its axis; and control means for controlling said swiveling means and said rotation means such that a period for swiveling said movable body overlaps with a period for rotating said holding member.

5. A toroidal coil winding apparatus as claimed in claim 4, wherein said control means controls said bringing means and said swiveling means such that a period for bringing said holding member overlaps with a period for swiveling said movable body.

6. A toroidal coil winding apparatus for winding a wire on a core comprising:

passing means for passing said wire through a center hole of said core from an entrance side to an exit side of said center hole;

a pair of movable bodies on which said wire is wound and which are movable in a direction of an axis of said core;

a holding member which holds said wire on said exit side at or near a tip of said wire which has passed to said exit side from said entrance side;

bringing means for bringing said holding member which is holding said wire at said exit side to said entrance side by crossing a path of said movable body on said exit side and moving around said core, and a pair of arms extending opposite to each other in an axial direction of said core, wherein each of said movable bodies is mounted on one of said pair of arms respectively, such that said movable bodies are adapted to move in longitudinal directions of said arms.

7. A toroidal coil winding apparatus as claimed in claim 6, further comprising first and second tension applying means for applying separately adjustable driving forces to each of said pair of movable bodies respectively in directions away from said core.

8. A toroidal coil winding apparatus as claimed in claim 7, wherein said tension apply means comprises:

a pair of belts each of which is routed via a center end and an outer end of each of said arms, wherein each end of said belts is connected to each of said movable bodies;

winching means for winching other ends of said belts independently; and torque adjust means for controlling torque of said winching means for winching said belts individually.

9. A toroidal coil winding apparatus as claimed in claim 8, wherein said arms are adapted to interchange their positions by swiveling about said core and moving in an axial direction of said swiveling action.

10. A method of winding a wire on a coil by a winding apparatus having a movable body on which said wire is wound and which moves in an axial direction of said core, comprising the steps of:

passing said wire through a center hole of said core from an entrance side to an exit side of said center hole;

holding said wire at or near a tip of said wire which has passed said center hole; and bringing said wire held in said holding step to said entrance side by crossing a path of said movable body and moving around said core, wherein said winding apparatus further has a feed chuck which holds said wire to feed said wire and a pull-out chuck which holds said wire to pull out said wire fed by said feed chuck, wherein said passing step includes the steps of:

inserting said wire to said center hole from said entrance side, said wire being held by said feed chuck at a position withdrawn by a predetermined length from a tip of said wire;

chucking said tip or said neighborhood of said tip which has been inserted into said central hole by said pull-out chuck on said exit side; and pulling out said wire from said center hole on said exit side by said pull-out chuck, and wherein said holding step includes the steps of:

moving said feed chuck around said core from said entrance side to said exit side; and chucking said wire, which has been pulled out by said pull-out chuck, by said feed chuck, which has moved in said moving step, at a position withdrawn by a predetermined length from a position where said wire is held by said pull-out chuck.

11. A method as claimed in claim 10, wherein said bringing step includes a step of bringing said feed chuck which chucked said wire in said chucking step to said entrance side by crossing said path of said movable body and moving around said core.

12. A method as claimed in claim 11, further comprising a step of tensioning and straightening said wire near said tip by said feed chuck and said pull-out chuck.

13. A method of winding a wire on a coil by a winding apparatus having a movable body on which said wire is wound and which moves in an axial direction of said core, comprising the steps of:

passing said wire through a center hole of said core from an entrance side to an exit side of said center hole;

holding said wire by a holding member on said exit side at or near a tip of said wire which has passed said center hole; and bringing said wire held in said holding step to said entrance side by crossing a path of said movable body and moving around said core;

swiveling said movable body from said exit side to said entrance side; and rotating said holding member which is holding on its axis said wire which is held on said exit side in said holding step, wherein said swiveling step overlaps simultaneously with said rotating step.

14. A method as claimed in claim 13, wherein said swiveling step overlaps simultaneously with said moving around step.

15. A method of winding a wire on a coil by a winding apparatus having a movable body on which said wire is wound and which moves in an axial direction of said core, comprising the steps of:

passing said wire through a center hole of said core from an entrance side to an exit side of said center hole;

holding said wire at or near a tip of said wire which has passed said center hole; and bringing said wire held in said holding step to said entrance side by crossing a path of said movable body and moving around said core;

wherein said winding apparatus further has an arm extending in an axial direction of said core, and wherein said movable body is mounted on said arm in such a way that said movable body is adapted to move in longitudinal directions of said arm, and wherein said bringing step includes a step of applying a driving force to said movable body on said arm in a direction away from said core.

16. A method as claimed in claim 15, wherein said winding apparatus comprises a pair of arms extending in an axial direction of said core, and further comprising a step of interchanging positions of said pair of arms by swiveling motion of said arms around said core and motion of said arms in an axial direction of said swiveling motion.

17. A method of winding a wire on a coil by toroidal coil winding apparatus, comprising:

a first step of inserting a tip of said wire into said core from an entrance side to an exit side of said core and pulling out said tip to said exit side;

a second step of moving said tip of said wire, which has been pulled out to said exit side of said core, around said core and bring said tip to said entrance side; and a third step of rotating said core around an axis thereof by a predetermined angle so that said wire is wound on a different portion of said core; and repeating said first to third steps, wherein said winding apparatus has a first chuck which holds said tip of said wire and moves between said entrance and exit sides of said core, a second chuck which holds said tip of said wire on said exit side and pulls out said tip, and a movable body around which said wire is wound on said exit side and moves between said exit and entrance sides;

said first step includes steps of holding said wire at a position withdrawn by a predetermined length from said tip of said wire by said first chuck on said entrance side of said core, moving said first chuck such that said tip of said wire, which has been held, comes out to said exit side of said core, holding and then pulling out said tip of said wire which has been pulled out to said exit side by said second chuck while opening said first chuck after said moving step, moving said first chuck from said entrance side to said exit side after said pulling out step, and re-gripping said wire at a position withdrawn from said tip by said first chuck; and said second step includes steps of, winding said wire around said movable body by moving said first chuck around said movable body on said exit side in such a way that said tip of said wire, which has been held by said first chuck, faces said entrance side, and bringing said tip to said entrance side by moving said first chuck and said movable body synchronously around said core while applying predetermined tension to said wire.

18. A toroidal coil winding apparatus for winding a wire on a core comprising:

a first chuck which is adapted to move between an entrance and exit sides of said core, and holds said wire at a position withdrawn by a predetermined length from a tip of said wire on one of said entrance side and said exit side of said core;

a moving mechanism which moves said first chuck such that said tip of said wire which has been held on said entrance side comes out to said exit side of said core;

a second chuck which holds and pulls out said tip of said wire which has come out to said exit side;

a movable body around which said wire is wound;

a winding mechanism which winds said wire around said movable body by moving said first chuck around said movable body in such a way that said tip of said wire, which has been pulled out by said second chuck and re-gripped by said first chuck on said exit side, faces said entrance;

a tension apply mechanism which tensions said wire while said wire is wound around said movable body; and a bring mechanism which brings said tip to said entrance side by moving said first chuck and said movable body synchronously around said core while applying tension to said wire by said tension apply mechanism.

* * * * *